US006517389B2

(12) United States Patent
Sato

(10) Patent No.: US 6,517,389 B2
(45) Date of Patent: Feb. 11, 2003

(54) TERMINAL COVER

(75) Inventor: Kei Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/940,456

(22) Filed: Aug. 29, 2001

(65) Prior Publication Data

US 2002/0025731 A1 Feb. 28, 2002

(30) Foreign Application Priority Data

Aug. 31, 2000 (JP) ..... 2000-262906

(51) Int. Cl.[7] ..... H01R 13/502
(52) U.S. Cl. ..... 439/701; 439/717
(58) Field of Search ..... 439/701, 712–717, 439/660, 682, 686

(56) References Cited

U.S. PATENT DOCUMENTS 6,007,386 A * 12/1999 Okabe ..... 439/701
6,358,098 B1 * 3/2002 Wakata ..... 439/701

* cited by examiner

*Primary Examiner*—Khiem Nguyen
(74) *Attorney, Agent, or Firm*—Armstrong, Westerman & Hattori, LLP

(57) ABSTRACT

A terminal cover for protecting a terminal held by an insulator is provided, by which deterioration in the production yield of a wiring harness is prevented. The terminal cover 10 protects a tab 37 of a pressure-welded terminal 30 for use in a joint connector, which is held by a housing 40. The housing 40 has a plate body 42 and a pair of guide projections. The housings 40 are laminated to each other and held by holders 51. The terminal cover 10 has a cover body 11, a tab-protecting member 12, and a pair of releasing projections 14. The cover body 11 is mounted by being nipped between a pair of guide projections 42*c*. The tab-protecting member 12 has a protecting projection 18 which situates the tab 37 between a bottom wall 42*a* of the plate body 42 and the protecting projection 18. The releasing projection 14 has an inclined surface 20, which enlarges a space between a pair of the guide projections 42*c* when the housing 40, having the terminal cover 10 thereon, is mounted in the holder 51.

7 Claims, 10 Drawing Sheets

TERMINAL COVER

BACKGROUND OF THE INVENTION (1) Field of the Invention

The present invention relates to a terminal cover to be mounted on an insulator so as to protect terminals held by the insulator, wherein the insulators are laminated with each other to constitute a joint connector.

(2) Description of the Related Art

In a motor vehicle as a mobile unit, a wiring harness is arranged to supply electric power from a power source such as a battery and the like to electronic equipment such as various lamps and motors to be mounted. The wiring harness has a plurality of electric wires, a plurality of terminals attached to ends of the electric wires, and connector housings for receiving the terminals therein. The connector housing and a plurality of terminals constitute a connector. In general the wiring harness has a plurality of connectors.

Recently, in response to the increase of the electronic equipments mounted on the motor vehicle, the wiring harness has been once constituted as a plurality of subhamesses, each of which is for a corresponding function of the electronic equipment, then obtained by assembling these subharnesses. Therefore, the connection of each electric wire among subharnesses becomes complicated, causing a deterioration in the workability during the assembly of the wiring harness and an insecure quality thereof when things come to the worst.

A joint connector 5 as shown in FIG. 22, by which the connection among electric wires can be easily carried out, has been proposed. A plurality of housings 40 as insulators shown in FIG. 17, on each of which pressure-welded terminals 30 shown in FIG. 14 for use in a joint connector 5 are mounted, are laminated with each other so as to obtain the joint connector 5 shown in FIG. 22.

The joint connector is defined as a connector, in which a plurality of terminals received in respective connector housings are electrically connected with each other in accordance with a predetermined pattern. In this case, the housings 40 to be laminated with each other corresponds to an aforementioned connector housing.

The pressure-welded terminal 30 is prepared, for example, by bending an electrically conductive sheet metal. As shown in FIGS. 14 and 15, the pressure-welded terminal 30 has a flat base 35*a* on which an electric wire 4 shown in figures such as FIG. 20 are placed, a pair of sidewalls 35*b*, a wire-connecting part 31, and an electric contacting part 32.

The base 35*a* is formed in a band plate-shape. Each of a pair of the sidewalls 35*b* is also formed in a band plate-shape. Each of a pair of the sidewalls 35*b* continues to a corresponding periphery of the base 35*a*. Each of a pair of the sidewalls 35*b* perpendicularly rise from the corresponding periphery of the base 35*a*.

The wire-connecting part 31 has a pair of bent pieces 33 facing each other and a pressure-welding part 31*a*. Each bent piece 33 arises perpendicularly with relation to the base 35*a*. A pair of the bent pieces 33 is bent toward the base 35*a* so as to hold the wire 4 placed on the base 35*a*.

The pressure-welding part 31*a* has three pairs of press-in blades 34*a*, 34*b* and 34*c* facing each other. The three pairs of press-in blades 34*a*, 34*b* and 34*c* arise perpendicularly with relation to the base 35*a* and protrude in the direction for accessing to each other from the inner face of the corresponding sidewall 35*b*.

The wire 4 is press-fit among the three pairs of press-in blades 34*a*, 34*b* and 34*c* so that the blades cut deep into a coating of the wire 4 to come into contact with the core of the wire 4, thereby the electric connection between the blades and the wire 4 is ensured, that is, the blades 34*a*, 34*b* and 34*c* are pressure-welded to the wire 4.

The electric contacting part 32 has an open hole 36 (as shown in FIG. 15) opened in the base 35*a* and a tab 37 as a connecting piece, which can rise from the base 35*a*. The tab 37 is formed in a band-shape. The tab 37 is formed integrally with the base 35*a* at an end of the tab 37 and continues to the wire-connecting part 31.

By being bent, the tab 37 can be set in either a state in which the tab 37 rises perpendicularly to the base 35*a* or a state in which the tab 37 is set parallel with the base 35*a* as shown in FIG. 14 by an alternate long and two short dashes line. Once the tab 37 is bent so as to rise perpendicularly to the base 35*a*, the tab 37 keeps this position, while when the tab 37 is set parallel with the base 35*a*, then the tab 37 keeps such a position.

The state in which the tab 37 rises perpendicularly to the base 35*a* corresponds to a state of electric connection, while the state in which the tab 37 is set parallel to the base 35*a* corresponds to a state of electric insulation. When one housing 40 in which the pressure-welded terminals 30 (for use in the joint connector 5) are held is laminated to another housing, the tab 37 in the electric connection state extends toward a pressure-welded terminal 30 held in the other housing. Moreover, the tab 37 in the electric connection state can be electrically connected to a pressure-welded terminal 30 held in the other housing. As shown in FIG. 15, the open hole 36 is provided with a contacting spring piece 36*a* to pressure-weld an end of the base 35*a* to the tab 37 of the other pressure-welded terminal.

The pressure-welded terminals 30 described above are laminated such that the bases 35*a* are set parallel with each other having a space therebetween. The tab 37 of one pressure-welded terminal situated below in FIG. 15 is inserted into the open hole 36 of the other pressure-welded terminal situated above in FIG. 15, thereby the electric contacting part 32 electrically connects the pressure-welded terminals, laminated with each other, to each other.

At this time, the tab 37 of the one pressure-welded terminal 30 situated below is nipped by the end of the base 35*a* and the contacting spring piece 36*a* of the other pressure-welded terminal 30 situated above.

Each pressure-welded terminal 30 is press-fit in a corresponding groove 41 for receiving a terminal in the housing 40, thereby each pressure-welded terminal 30 is received in and held by the housing 40.

Upon the press-fitting of the pressure-welded terminal 30 into the groove 41, when the pressure-welded terminals 30 adjacent to each other are to be electrically connected, a connecting member 39 that connects ends of the base 35*a* near to the wire-connecting part 31 to each other is left without being removed from the base 35*a* as shown in FIG. 16. When the pressure-welded terminals 30 adjacent to each other are kept being electrically insulated, the connecting member 39 is removed from the base 35*a*.

The housing 40 is made of electrically insulating synthetic resin and has a rectangular plate body 42 and a plurality of grooves 41 for receiving a terminal as shown in FIGS. 17–22. The plate body 42 has a bottom wall 42*a*, a pair of sidewalls 42*b*, and a plurality of partition walls 43, each of which rises perpendicularly from the bottom wall 42*a*.

The bottom wall 42*a* is formed flat and rectangular in its plane shape. The sidewalls 42*b* are arranged in parallel facing each other. Each sidewall 42*b* is formed continuously from the corresponding periphery of the bottom wall 42*a*. Each sidewall 42*b* rises perpendicularly to the bottom wall 42*a,* that is, each sidewall 42*b* arises perpendicularly from the corresponding periphery of the bottom wall 42*a*.

Each sidewall 42*b* is provided with a guide projection 42*c*. The guide projection 42*c* protrudes in the direction for leaving from the bottom wall 42*a* from an end of the sidewall 42*b,* which is distant from the bottom wall 42*a*. That is, the guide projection 42*c* rises perpendicularly from the corresponding periphery of the bottom wall 42*a*.

Each guide projection 42*c* is formed in a blade-shape along the sidewall 42*b*. When the housings 40 are laminated with each other, the guide projection 42*c* guides the housing 40 in such a manner that a locking claw 44 (explained later on) of one housing 40 and a corresponding claw receiver 45 (explained later on) of another housing 40 are engaged with each other.

The partition walls 43 are arranged in parallel with each other having a space therebetween. The partition walls 43 are arranged in parallel with a pair of the sidewalls 42*b* between a pair of the sidewalls 42*b*.

The groove 41 for receiving the pressure-welded terminal 30 is surrounded by the partition walls 43 adjoining each other and the bottom wall 42*a*. A plurality of grooves 41 are formed. As shown in FIG. 18, the pressure-welded terminal 30 is placed on one surface 47*a* of the bottom wall 42*a*. On the other hand, the pressure-welded terminal 30 is not placed on another surface 47*b* of the bottom wall 42*a,* which is situated at the back of the surface 47*a*.

Each sidewall 42*b* is provided with a hollow groove 48*a* and a through hole 48*b*. Each hollow groove 48*a* extends along the groove 41 and is formed so as to become hollow from a surface of the corresponding sidewall 42*b,* which is located outside the housing 40. The through hole 48*b* runs along the direction from the one surface 47*a* to the other surface 47*b* in the sidewall 42*b*. The through hole 48*b* is formed in a rectangular shape in its plan view.

As shown in FIG. 19, in the housing 40, each pressure-welded terminal 30 is inserted into the groove 41, which is selected as desired out of a plurality of the grooves 41. The pressure-welded terminal 30 is inserted into the groove 41 from an end of the groove 41 as shown in FIG. 18.

The housings 40, in each of which the terminal 30 is inserted, is laminated with each other in such a manner that the plate bodies 42 are laminated parallel with each other having a space therebetween, thereby constructing the connector (joint connector) 5 as shown in FIG. 22.

At this time, as shown in FIG. 20, the wire 4 is pressure-welded to the terminal 30, which is received in and held by the housing 40. Then, as shown in FIG. 21, the housings 40, in each of which the wire 40 is mounted, are laminated with each other. Further, the terminals 30 are electrically connected to each other when the corresponding housings 40 are laminated adjacently with each other and the corresponding tab 37 is set in the electric connection state, and the terminals 30 adjacently situated are electrically connected to each other when the connecting member 39 is left without being removed.

When the housings 40 are laminated with each other to construct the joint connector 5, a cover housing 49 is laminated atop thereof as shown in FIG. 21. Since the cover housing 49 has a similar structure to that of the housing 40, the same reference numerals are used for the same elements thereof. The cover housing 49 is not provided with the partition wall 43, therefore no groove 41 for receiving a terminal is formed therein.

Although FIGS. 19–22 are illustrated in such a manner that a terminal 30 is received into every groove 41, the housing 40 does not necessarily receive a terminal 30 into every groove 41 thereof. That is, in the housing 40, a pressure-welded terminal 30 is inserted into only the groove 41, which is selected as desired from a plurality of the grooves 41.

The housing 40 is provided with a plurality of holes (not shown in the figure), which do not disturb the tab 37 of the terminal 30 situated below from entering into the open hole 36 of the terminal 30 situated above.

Furthermore, the housing 40 and the cover housing 49 have a plurality of the locking claws 44 and the claw receivers 45, by which these housings fix to each other upon the lamination thereof. As shown in FIG. 17B, the locking claw 44 protrudes from the other surface 47*b* on which the terminal 30 is not placed. As shown in FIG. 17B, the claw receiver 45 is provided between the sidewall 42*b* and the partition wall 43, which is situated nearest to the sidewall 42*b*. The claw receiver 45 of one housing 40 engages with the locking claw 44 of the other housing 40, which is adjacently laminated on the one housing 40.

When the wiring harness is constituted with the housings 40 described above, first the wire 40 is pressure-welded to the terminal 30 mounted in the housing 40, thereby the subharness is constituted. Then, the housings 40 of the subharness are laminated to each other, thereby the joint connector 5 is constructed and the wiring harness is assembled.

Further, in an assembly line for assembling the wiring harness, at least the subharness needs to be conveyed from a pressure-welding step of the wire 4 in the housing 40 to a laminating step of the housings 40. Consequently, there is the possiblity that the tab 37 is deformed by being touched by hands of the workers. If the tab 37 is deformed, the terminals 30 cannot be securely connected to each other, causing a deterioration in the production yield of the wiring harness.

Furthermore, if the tab 37 is deformed, there is the possibility that the tab 37 disturbs the engagement between the locking claw 44 and the claw receiver 45 when the housings 40 are laminated to each other. Therefore, the housings 40 cannot be securely laminated to each other, causing a further deterioration in the production yield of the wiring harness.

SUMMARY OF THE INVENTION

It is therefore an objective of the present invention to solve the above problem and to provide a terminal cover for protecting a terminal, which is mounted to the insulator constructing the joint connector by the lamination thereof and held by the insulator, thereby preventing deterioration in the production yield of the wiring harness.

In order to attain the above objective, the present invention provides a terminal cover to be mounted on an insulator, which arranges and holds a plurality of pressure-welded terminals in parallel therein, a plurality of the insulators being mutually laminated to constitute a joint connector. When the terminal is held by the insulator and the insulator being laminated to the other insulator, the terminal having a connecting piece, which extends toward the other terminal mounted in the other insulator and is connectable to the other terminal. The insulator has a wall for placing the terminal thereon and a pair of guide projections perpendicularly arising from a pair of the peripheries of the wall facing each other, and the terminal cover comprising: a cover body to be mounted on the insulator being nipped between a pair of the guide projections; and a protecting projection, which protrudes from an end of the cover body toward the outside and situates the connecting piece between the wall and the protecting projection when the cover body is mounted on the insulator.

According to the construction described above, the connecting piece is situated between the protecting projection and the wall, thereby preventing hands of the workers and so on from touching the connecting piece during the conveyance of the intermediate products from one step to another step of the assembly of the wiring harness. Therefore, the connecting piece is prevented from deforming during the assembly of the wiring harness, thereby a deterioration in the production yield of a wiring harness is prevented.

Preferably, an end of the cover body is provided with a flat protecting surface along the direction in which the connecting piece extends toward the other terminal, the protecting surface comes into contact with the connecting piece when the cover body is mounted on the insulator, and the protecting projection protrudes from the protecting surface toward the outside.

According to the construction described above, the protecting surface is formed along the connecting piece and comes into contact with the connecting piece when the cover body is mounted on the insulator, thereby the protecting surface prevents the connecting piece from deforming during the conveyance of the intermediate products. Further, the protecting projection protrudes from the protecting surface, thereby securely situating the connecting piece between the wall and the protecting projection and more securely preventing hands of the workers and so on from touching the connecting piece during the conveyance of the intermediate products from one step to another step of the assembly of the wiring harness. Therefore, the connecting piece is securely prevented from deforming during the assembly of the wiring harness, thereby a deterioration in the production yield of a wiring harness is securely prevented.

Preferably, the insulator has a claw receiver engaging with a locking claw of the other insulator when the insulators are mutually laminated so as to constitute the joint connector, and the terminal cover has a locking member, which protrudes from the cover body toward the claw receiver and engages with the claw receiver when the cover body is mounted on the insulator.

According to the construction described above, the locking member engages with the claw receiver of the insulator, thereby the cover body is securely prevented from positionally being off in relation to the insulator upon its mounting on the insulator. Therefore, the connecting piece is securely prevented from deforming during the assembly of the wiring harness, and a deterioration in the production yield of a wiring harness is securely prevented.

Preferably, the insulators are mutually laminated so as to constitute the joint connector by using a setting jig having a plurality of holders, which are capable of holding the insulators and separable from each other, the insulator is mounted in the holder by being moved along the wall, and the terminal cover has a pair of lock releasing members for enlarging a space between a pair of the guide projections as the insulator is mounted in the holder when the terminal cover is mounted on the insulator.

According to the construction described above, the lock releasing members gradually enlarge the space between a pair of the guide projections as the insulator is mounted in the holder, thereby the cover body is detached from the insulator in response to the mounting of the insulator. Therefore, the connecting piece is securely prevented from deforming during the assembly of the wiring harness, and a deterioration in the production yield of a wiring harness is securely prevented and the time required for assembling the wiring harness can be reduced.

Preferably, the lock releasing member comprises: a releasing member body, which protrudes from the periphery of the cover body toward the outside, a pair of the peripheries having a space therebetween along the direction crossing at right angles to the mounting direction of the insulator into the holder, and comes into contact with the setting jig when the insulator is mounted in the holder; and an inclined surface, which is provided at an end of the releasing member body near to the guide projection, capable of coming into contact with the guide projection, and gradually inclined toward the inner direction of the cover body as approaching the guide projection.

According to the construction described above, when the insulator is mounted in the holder, the inclined surface securely gradually enlarges the space between a pair of the guide projections, thereby the cover body is securely detached from the insulator in response to the mounting of the insulator. Therefore, the connecting piece is securely prevented from deforming during the assembly of the wiring harness, and a deterioration in the production yield of a wiring harness is securely prevented and the time required for assembling the wiring harness can be reduced.

Preferably, the locking member gradually slips out from the claw receiver along the mounting direction of the insulator as the insulator is mounted into the holder.

According to the construction described above, the cover body is more securely detached from the insulator in response to the mounting of the insulator into the holder. Therefore, the connecting piece is securely prevented from deforming during the assembly of the wiring harness, and a deterioration in the production yield of a wiring harness is securely prevented and the time required for assembling the wiring harness can be reduced.

DESCRIPTION OF THE PREFERRED EMBODIMENTS

Figure 1:
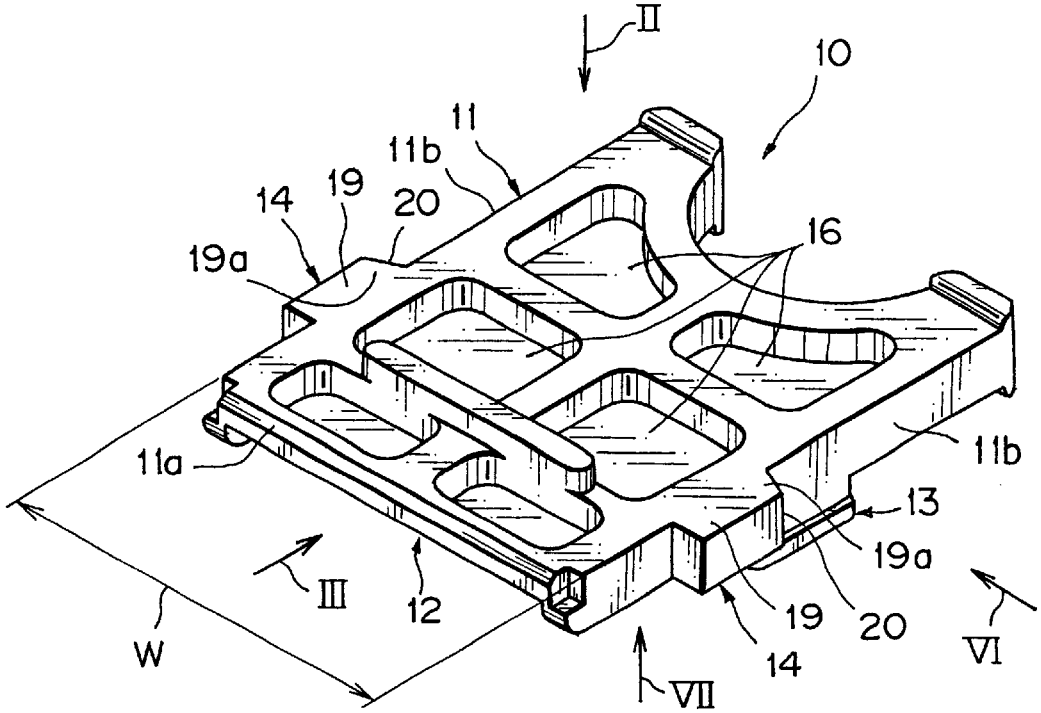
FIG. 1 is a perspective view illustrating a terminal cover according to a preferred embodiment of the present invention.
Figure 2:
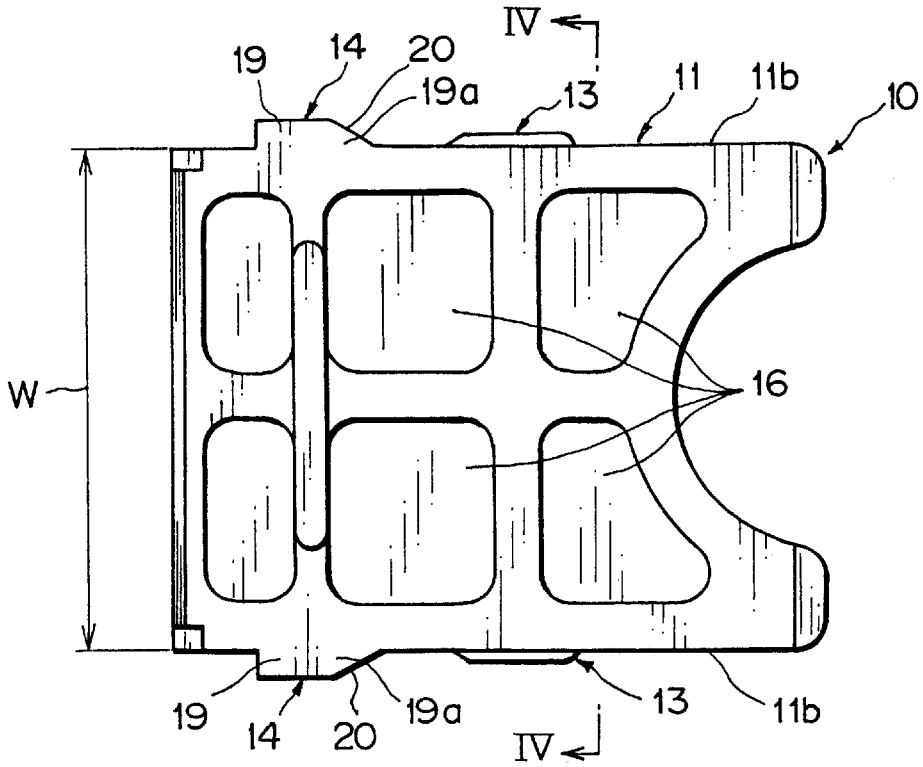
FIG. 2 is a view viewed from the direction of arrow II in FIG. 1.

In the following, a terminal cover 10 according to a preferred embodiment of the present invention will be explained with reference to FIGS. 1–13. The terminal cover 10 is defined as a cover, which is mounted on a housing 40 described above and protects in particular a tab 37 of a pressure-welded terminal 30 for use in a joint connector. The terminals 30 are held by the housing 40.

As shown in FIGS. 1–7, the terminal cover 10 comprises a cover body 11, a tab-protecting member 12 as a protecting member of the connecting piece, a locking projection 13 as the locking member, a releasing projection 14 as the lock releasing member, and a positioning projection 15. The terminal cover 10 is a solid material in which the cover body 11, the tab-protecting member 12, the locking projection 13, the releasing projection 14 and the positioning projection 15 are united.

Figure 8:
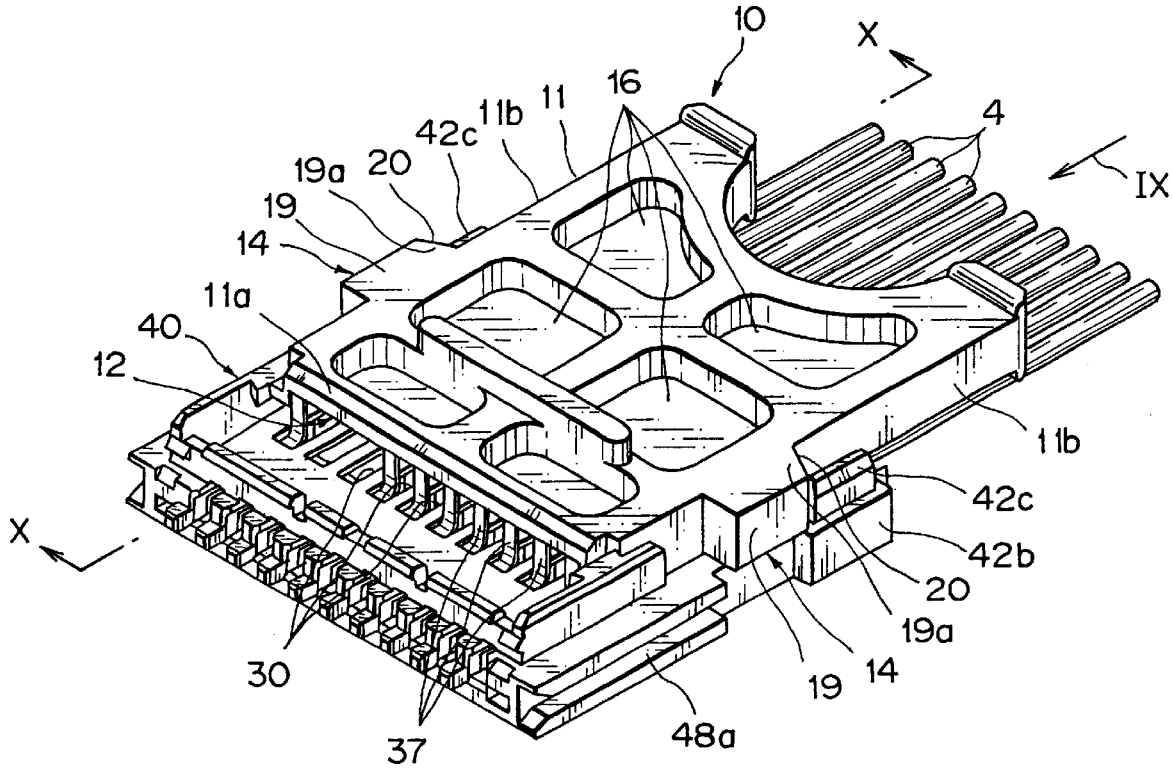
FIG. 8 is a perspective view illustrating a state when the terminal cover shown in FIG. 1 is mounted on a housing.
Figure 15:
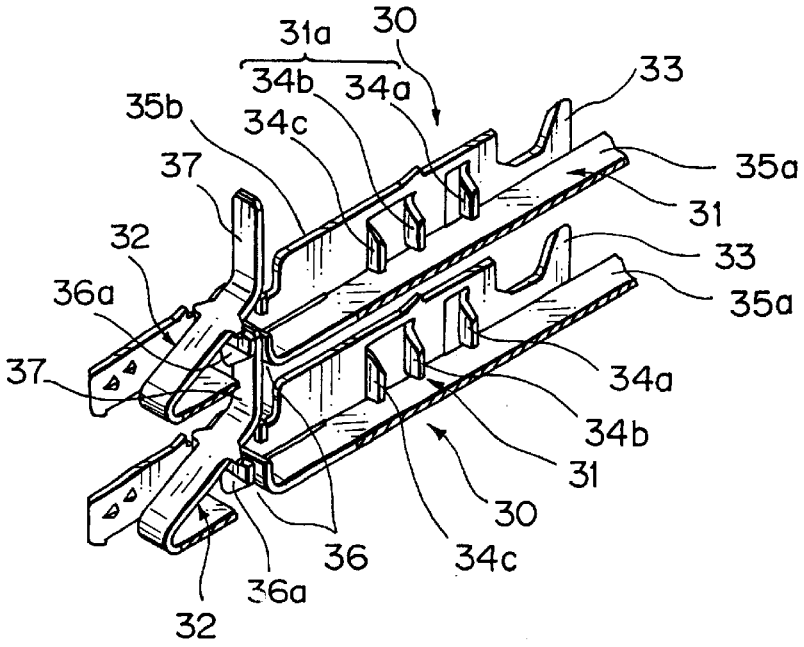
FIG. 15 is a view illustrating a state when the terminals shown in FIG. 14 are laminated so as to electrically connect to each other.

The cover body 11 is formed in a flat plate-shape, the width W of which is a little longer than the space between a pair of the guide projections 42*c*. As shown in FIG. 8, the cover body 11 is press-fit between a pair of the guide projections 42*c* to be mounted on the housing 40. At this time, the cover body 11 is in parallel with the bottom wall 42*a* having a space therebetween.

That is, the cover body 11 is mounted on the housing 40 being nipped between a pair of the guide projections 42*c*. When the cover body 11 is mounted on the housing 40, an outer surface of the cover body 11 is provided with a plurality of hollows 16, which are formed becoming hollow from the outer surface of the cover body 11. These hollows 16 give stiffness to the cover body 11 and make the cover body 11 light.

Figure 3:
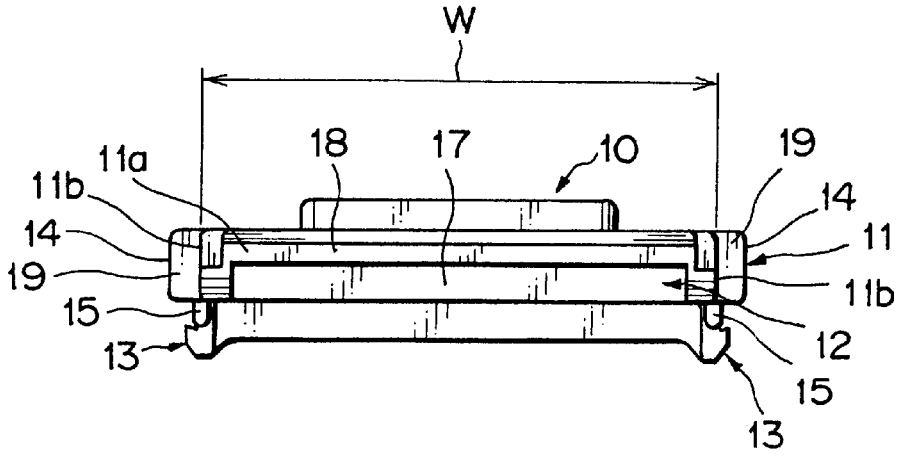
FIG. 3 is a view viewed from the direction of arrow III in FIG. 1.
Figure 4:
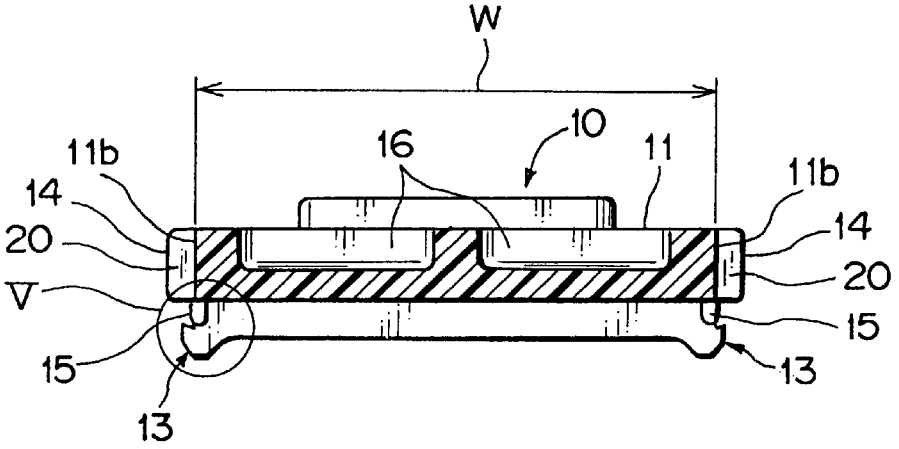
FIG. 4 is a cross sectional view taken along IV—IV line in FIG. 2.
Figure 5:
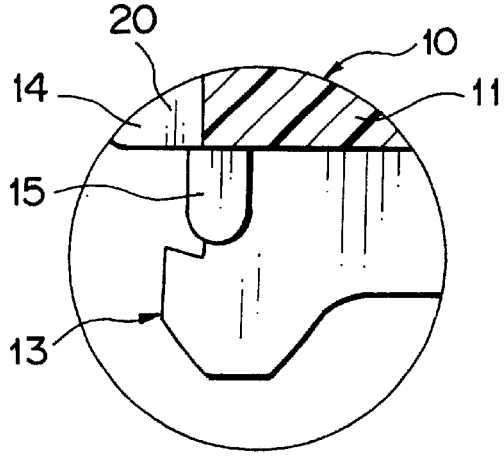
FIG. 5 is an enlarged view of a portion V in FIG. 4.
Figure 6:
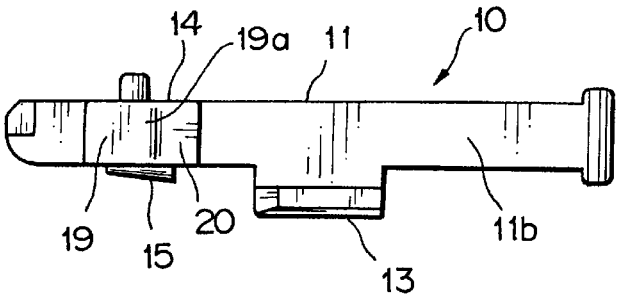
FIG. 6 is a view viewed from the direction of arrow VI in FIG. 1.
Figure 7:
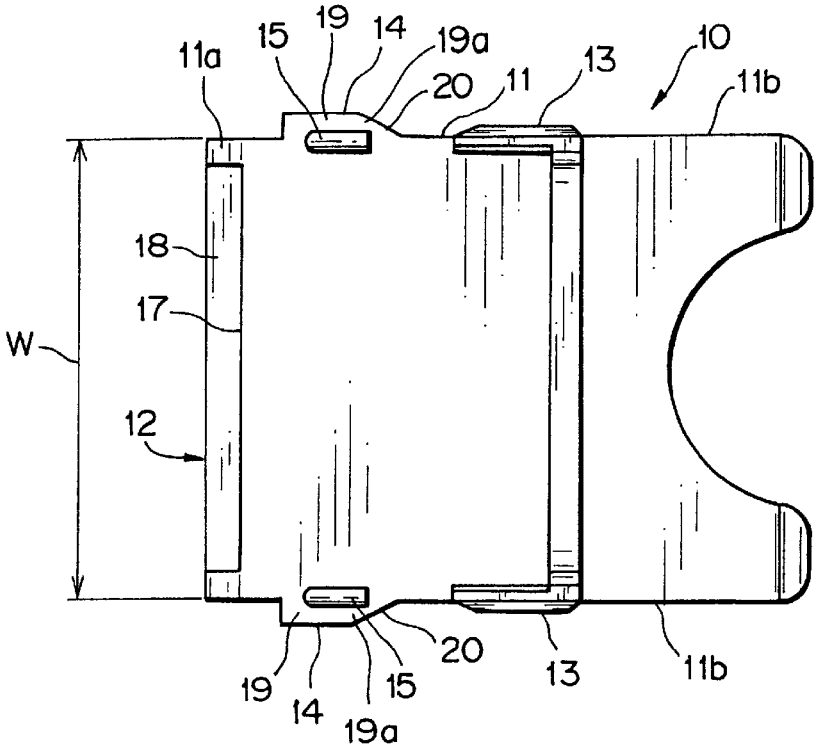
FIG. 7 is a view viewed from the direction of arrow VII in FIG. 1.

The tab-protecting member 12 is formed at an end 11*a* of the cover body 11 as shown in FIGS. 1, 3 and 7. As shown in FIG. 8, when the cover body 11 is mounted on the housing 40, the tab-protecting member 12 faces the tab 37 of the terminal 30 held by the housing 40. The tab-protecting member 12 is formed from one side 11*b* coming into contact with one guide projection 42*c* out of a pair of the projections 42*c* to another side 11*b* coming into contact with another guide projection 42*c* out of a pair of the projections 42*c*.

A pair of the sides 11*b* of the cover body 11 corresponds to a pair of the peripheries of the cover body 11. A pair of the sides 11*b* face each other along the direction crossing at right angles with the mounting direction of the housing into a setting jig 1 (explained later on) having a space therebetween.

Figure 10:
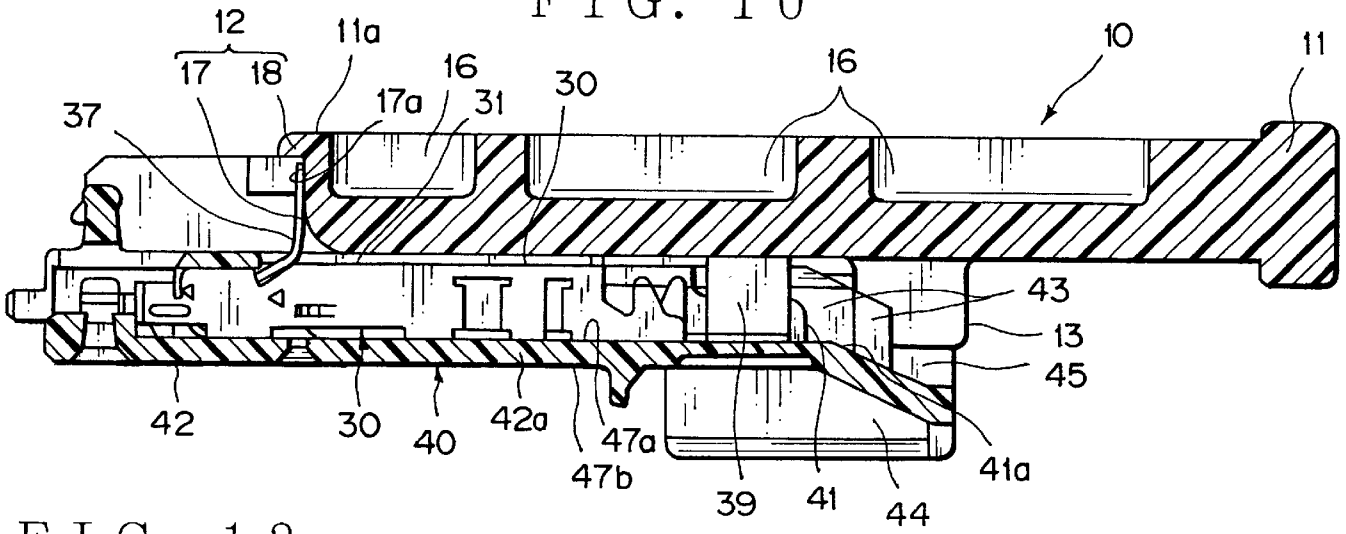
FIG. 10 is a cross sectional view taken along X—X line in FIG. 8.

As shown in FIGS. 3, 7 and 10, the tab-protecting member 12 has a protecting surface 17 and a protecting projection 18. The protecting surface 17 is formed flat along the direction away from the bottom wall 42*a* when the cover body 11 is mounted on the housing 40. The protecting surface 17 is formed flat along the extending direction of the tab 37 in the connecting state of the terminal 30 held by the housing 40. The protecting surface 17 is formed flat from the one side 11*b* to the other side 11*b* of the cover body 11.

The protecting projection 18 protrudes from the protecting surface 17 towards the outside of the cover body 11. That is, the protecting projection 18 protrudes from the end 11*a* of the cover body 11 towards the outside. The protecting projection 18 is formed at the periphery 17*a* of the protecting surface 17 away from the housing 40. The protecting projection 18 protrudes from the protecting surface 17 in a range from the one side 11*b* to the another side 11*b*.

When the cover body 11 is mounted on the housing 40, the protecting surface 17 of the tab-protecting member 12 comes into contact with the tab 37 as shown in FIG. 10. The protecting projection 18 situates the tab 37 between the bottom wall 42*a* and the protecting projection 18.

As shown in FIG. 10, the locking projection 13 protrudes from the cover body 11 toward the housing 40 on which the cover body 11 is mounted. The locking projection 13 is formed in the vicinity of the side 11*b* of the cover body 11. That is, each locking projection 13 is formed at the corresponding periphery of the cover body 11. The locking projection 13 is formed in about the same external shape as that of the locking claw 44.

Figure 9:
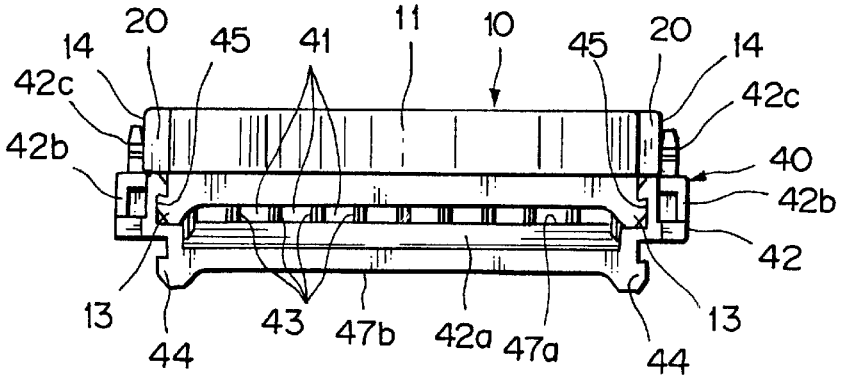
FIG. 9 is a view viewed from the direction of arrow IX in FIG. 8.

As shown in FIG. 9, when the cover body 11 is mounted on the housing 40, each locking projection 13 engages with the claw receiver 45 of the housing 40, thereby fixing the cover body 11 on the housing 40 to prevent the cover body 11 from leaving the housing 40 along the direction of approaching to or leaving from the bottom wall 42*a*. When the cover body 11 moves in relation to the housing 40 in the leaving direction of the protecting surface 17 from the tab 37, the locking projection 13 slips out (disengages) from the claw receiver 45 along the moving direction of the cover body 11 in relation to the housing 40. That is, the locking projection 13 gradually slips out from the claw receiver 45 as the housing is mounted in the holder 51.

As shown in FIGS. 1, 4, 6 and 7, the releasing projection 14 is formed on the side 11*b* of the cover body 11. That is, a pair of the releasing projections 14 is formed. As shown in FIG. 8, when the cover body is mounted on the housing 40, each releasing projection 14 is situated nearer to the tab 37 than the guide projection 42*c*. Each releasing projection 14 has a projection body 19 as a body of the releasing member body, which protrudes from the side 11*b* toward the outside of the cover body 11.

When the housing 40, on which the cover body 11 is mounted, is mounted in the setting jig 1, the projection body 19 comes into contact with guide members 52 and 53 (explained later on) of the setting jig 1.

The inclined surface 20 is formed at an end 19*a* of the projection body 19 near to the guide projection 42*c*. As facing the guide projection 42*c*, the inclined surface 20 gradually inclines toward the inside of the cover body 11 in relation to the mounting direction of the housing 40 into the setting jig 1.

When the cover body 11 moves with relation to the housing 40 in the leaving direction of the protection surface 17 from the tab 37, the inclined surface 20 comes into contact with the guide projection 42*c*. When the cover body 11 moves with relation to the housing 40 in the leaving direction of the protection surface 17 from the tab 37, the inclined surafce 20 elastically deforms the guide projection 42*c* in the direction enlarging the space between a pair of the guide projections 42*c*.

As shown in FIGS. 3–7, the positioning projection 15 protrudes from the cover body 11 toward the housing 40, on which the cover body 11 is mounted. The positioning projection 15 is formed in the vicinity of the side 11*b* of the cover body 11. That is, a pair of the positioning projections is formed.

When the cover body 11 is mounted on the housing 40, each positioning projection 15 is arranged at a position facing a through hole 48*b* of the housing 40. When the cover body 11 is mounted on the housing 40, each positioning projection 15 enters into the through hole 48*b*, thereby relatively positioning the cover body 11 and the housing 40.

When the terminal cover 10 is mounted on the housing 40, the cover body 11 is nipped between a pair of the guide projections 42*c* and the locking projection 13 engages with the claw receiver 45, thereby the terminal cover 10 is securely fixed on the housing 40. Therefore, the terminal cover 10 never abruptly comes off from the housing 40, on which the terminal cover 10 is once mounted, during the assembly of the wiring harness.

Further, the positioning projection 15 enters into the through hole 48*b*, thereby the relative position of the cover body 11 in relation to the housing 40 is never off during the assembly of the wiring harness. Therefore, the tab-protecting member 12 securely protects the tab 37.

The protecting surface 17 is formed along the tab 37 and comes into contact with the tab 37 when the cover body 11 is mounted on the housing 40. The protecting projection 18 protrudes from the protecting surface 17 so as to situate the tab 37 between the bottom wall 42*a* and the protecting projection 18. Therefore, when the terminal cover 10 is mounted on the housing 40, the tab-protecting member 12 prevents hands of the worker and so on from coming into contact with the tab 37.

Since hands of the workers and so on are prevented from touching the tab 37 during the assembly of the wiring harness, the tab 37 is prevented from deforming, and a deterioration in the production yield of a wiring harness is prevented.

Figure 11:
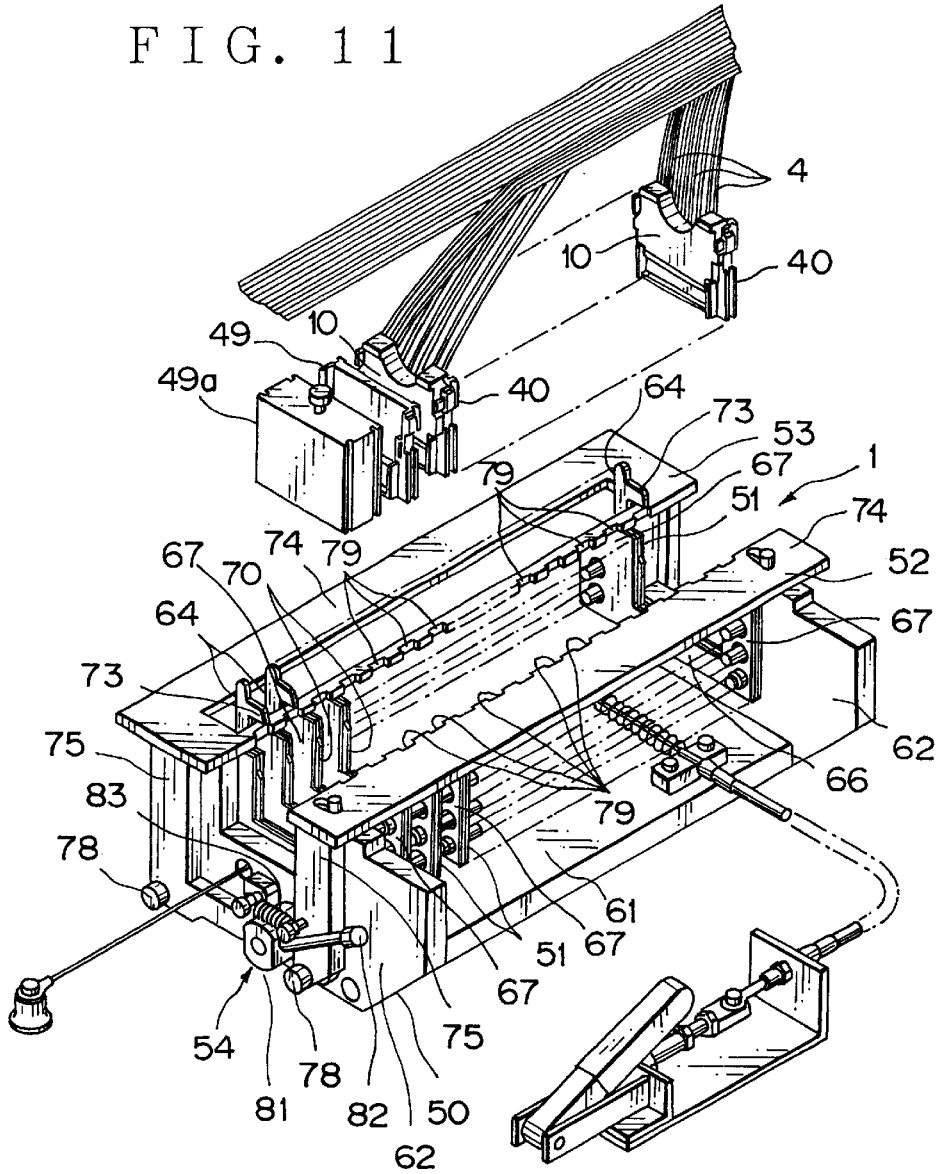
FIG. 11 is a perspective view illustrating a setting jig used when the housings shown in FIG. 8 are laminated to each other.
Figure 14:
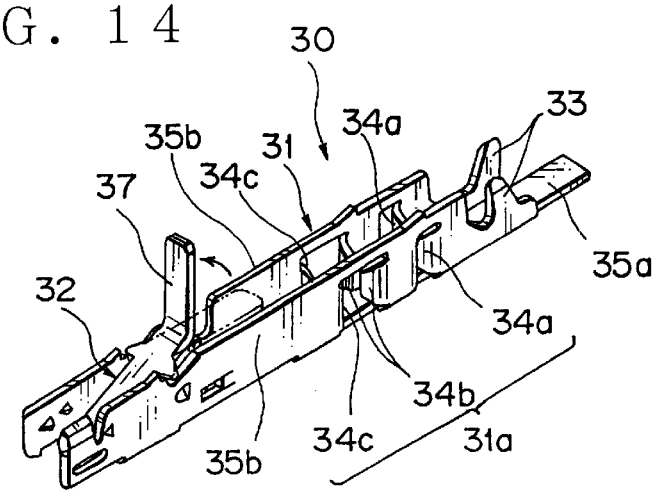
FIG. 14 is a perspective view illustrating a pressure-welded terminal for use in a joint connector received in a housing on which the terminal cover is to be mounted.
Figure 16:
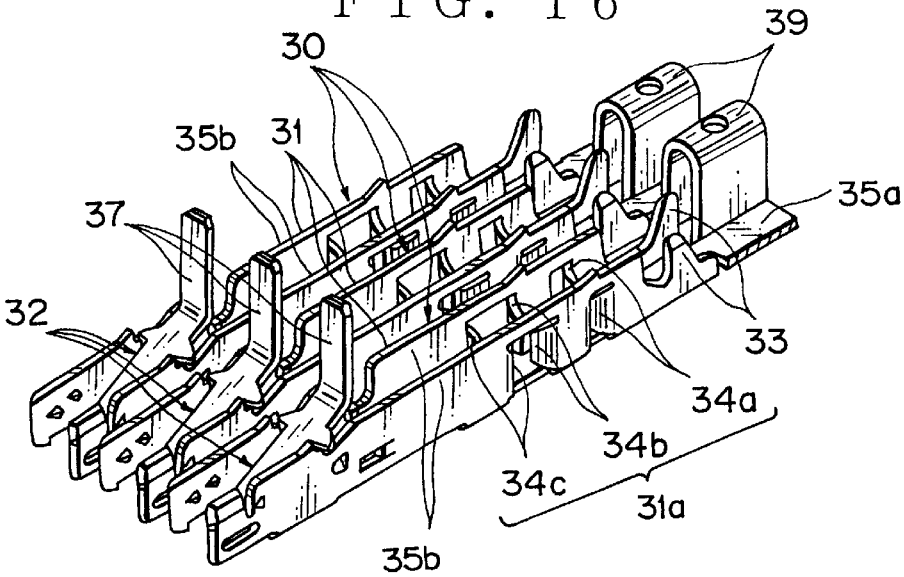
FIG. 16 is a view illustrating a state when the terminals shown in FIG. 14 are lined up in parallel so as to electrically connect to each other.
Figure 17A:
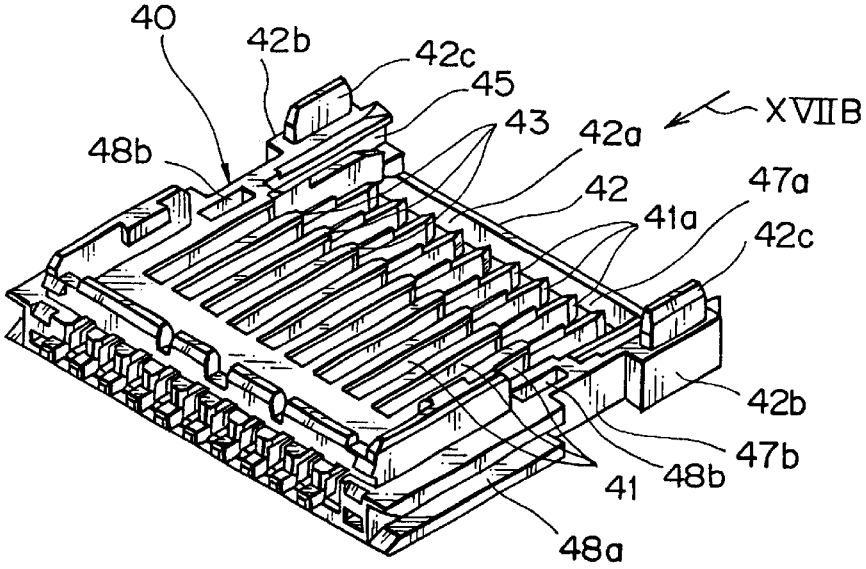
FIG. 17A is a perspective view illustrating the housing in which the terminals shown in FIG. 14 are received.
Figure 17B:
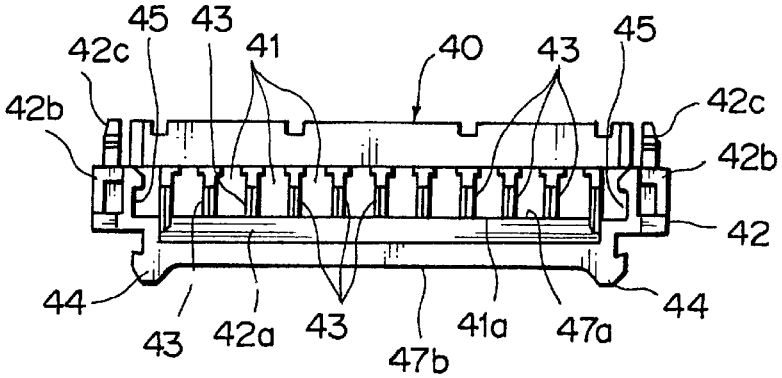
FIG. 17B is a view viewed from the direction of arrow XVIIB in FIG. 17A.
Figure 18:
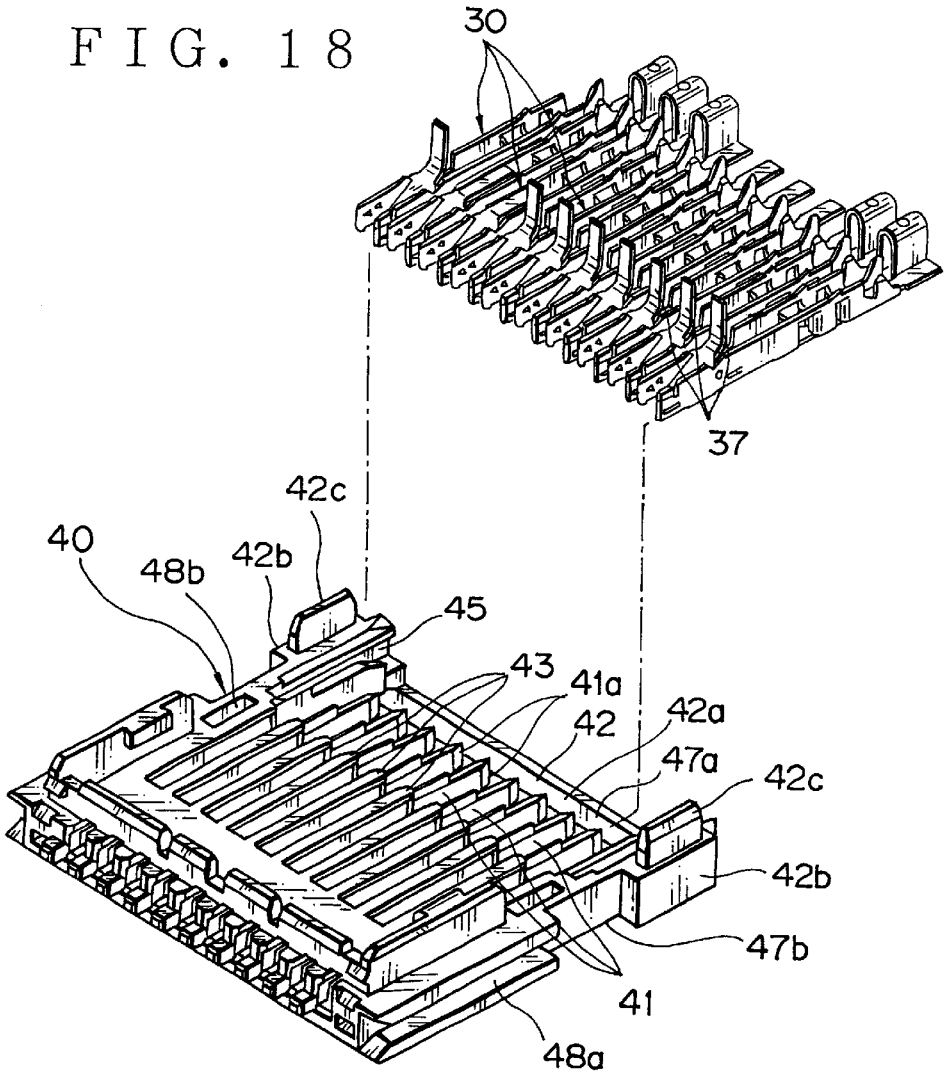
FIG. 18 is a perspective view illustrating a state when the terminal is press-fit into the housing shown in FIG. 17A.
Figure 19:
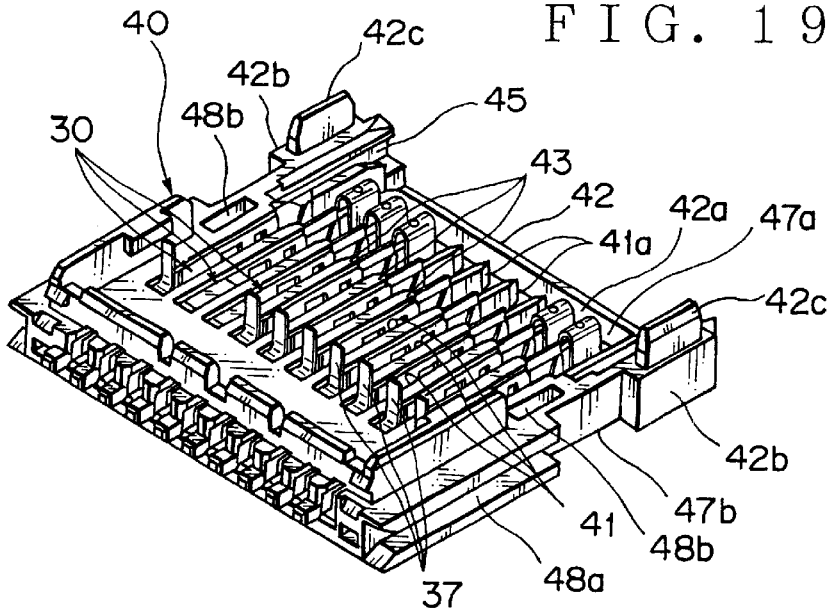
FIG. 19 is a perspective view illustrating a state when the terminal is held by the housing shown in FIG. 17A.
Figure 20:
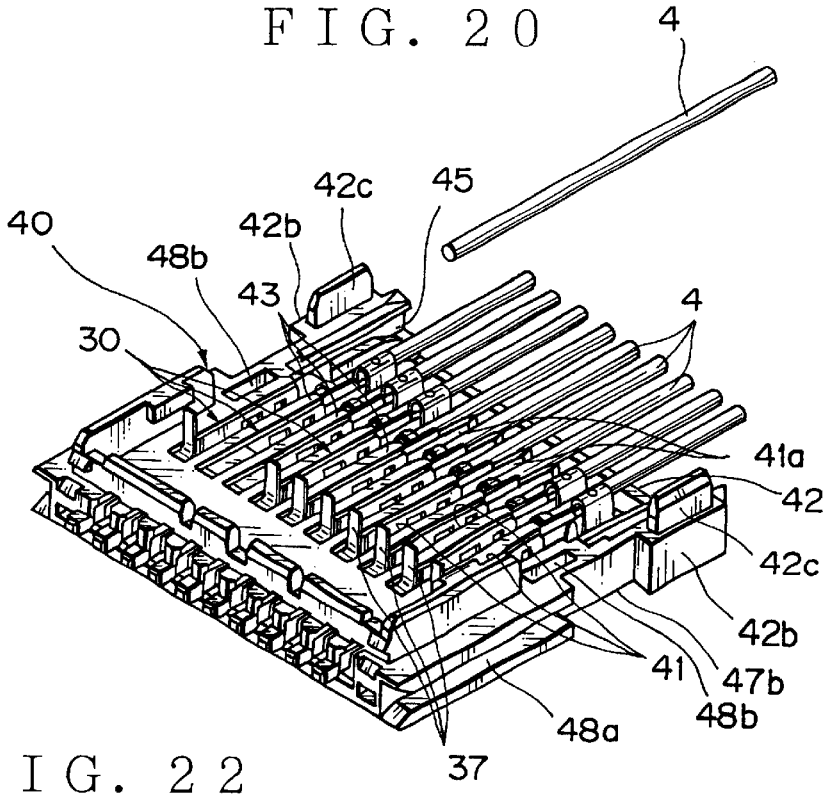
FIG. 20 is a perspective view illustrating a state when the wire is pressure-welded to the terminal held by the housing shown in FIG. 19.
Figure 22:
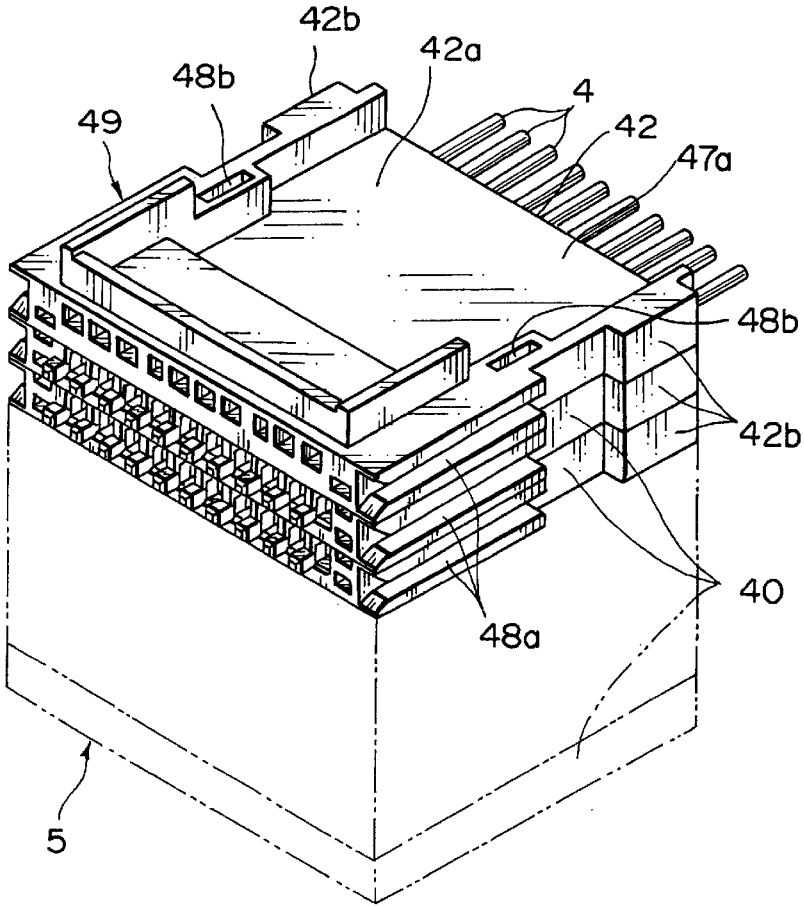
FIG. 22 is a perspective view of a joint connector, in which the housings shown in FIG. 20 are laminated to each other.
Figure 21:
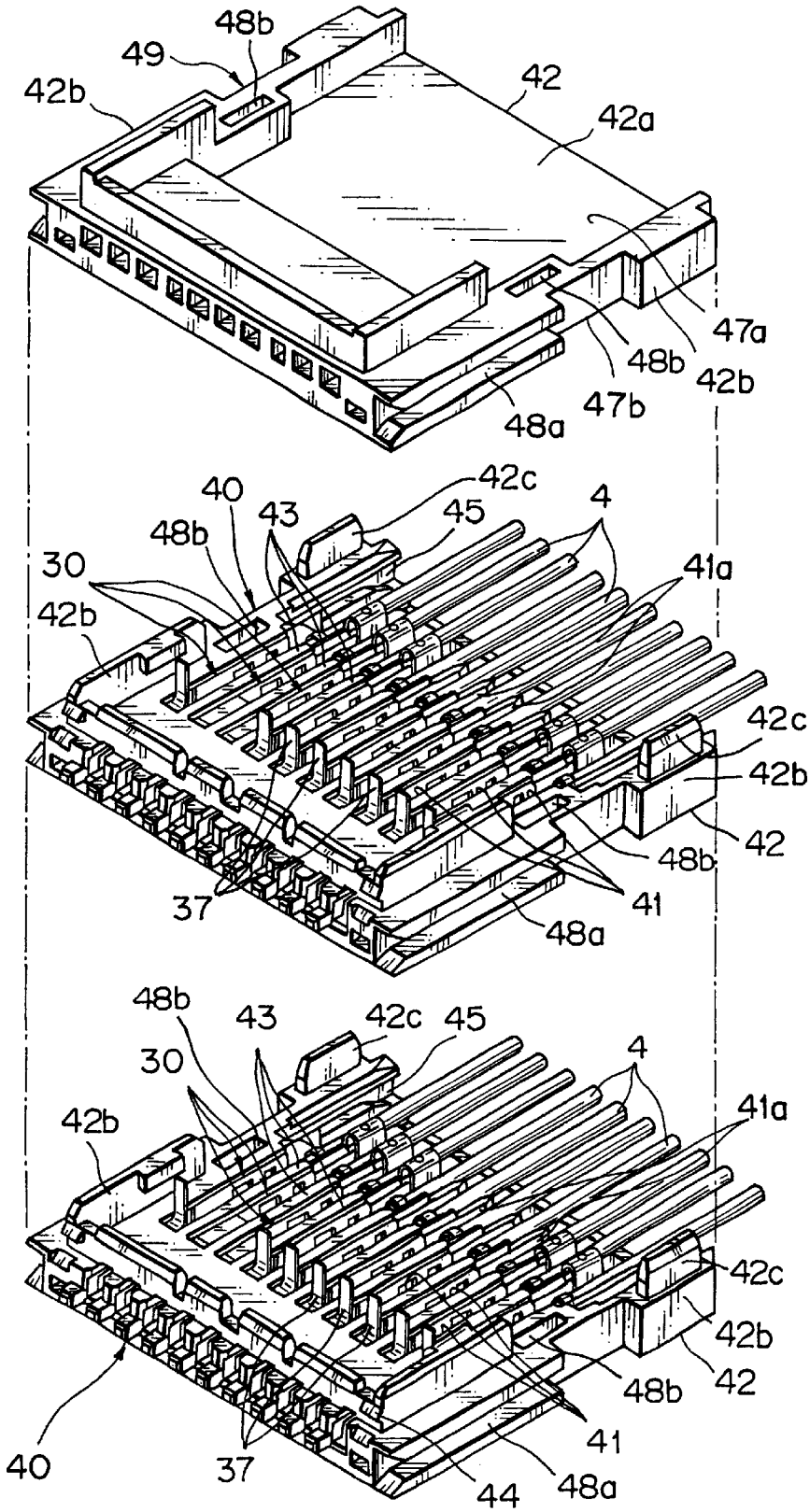
FIG. 21 is a perspective view illustrating a state when the housings shown in FIG. 20 are laminated to each other having a space therebetween.

After the wire 4 is pressure-welded to the terminal 30 for use in a joint connector, which is held by the housing 40, the housings 40 are laminated to each other by using the setting jig 1 shown in FIG. 11. As shown in FIG. 11, the setting jig 1 has a frame 50, a plurality of holders 51, a pair of guide members 52 and 53, and a cam mechanism 54.

The frame 50 has a base plate 61, and a pair of end plates 62. The base plate 61 is made of metal and the like, and formed in a band plate-shape. Each end plate 62 is made of metal and formed in a plate-shape. Each end plate 62 is connected to the corresponding periphery of the base plate 61, rising perpendicularly from the base plate 61.

The holders 51 are detachably held by the frame 50 and arranged between a pair of the end plates 62. The holder 51 is provided fourteen in the figure as an example. The holder 51 has a holding piece 66 and a pair of side pieces 67 arranged in parallel with each other continuing the corresponding periphery of the holding piece 66.

A projection 70, which can enter into the hollow groove 48*a*, is formed at the inner periphery of a pair of the side pieces 67. The projection 70 is formed along the length direction of the side piece 67.

The holder 51 is arranged in such a manner that the length direction of the holding piece 66 runs along the surface of the base plate 61 and the length direction of the side piece 67 runs along the direction approaching to or leaving from the base plate 61. Each holder 51 holds a corresponding housing 40. The holder 51 mounts the housing 40 along the bottom wall 42*a* approaching the housing 40 to the holding piece 66. The holder 51 holds the housing 40 by placing it on the holding piece 66 and nipping it between a pair of the side pieces 67. At this time, the projection 70 enters into the hollow groove 48*a* of the housing 40.

The holder 51 also has a lever member 64, which is formed in a pillar-shape extending along one direction. The lever member 64 is arranged in a manner that the length direction thereof runs along the length direction of the side piece 67. The lever member 64 is rotatably held by the side piece 67 around a shaft attached at the center of the lever member 64 in the length direction thereof.

The lever member 64 has a claw 73 at an end thereof away from the holding piece 66 upon being mounted to the side piece 67. The claw 73 can engage with the periphery of the housing 40 held by the holder 51. The lever member 64 is biased in the engaging direction of the claw 73 with the periphery of the housing 40 by a coil spring (not shown in the figure).

As shown in FIG. 11, each of the guide members 52 and 53 unitedly has a guiding part 74 formed in a band plate-shape and a pair of rotation holding parts 75. The guiding part 74 is formed having equal size to or a little longer size than that of the base plate 61. Each rotation holding part 75 is formed in a plate-shape continuing to the periphery of the guiding part 74.

The guiding part 74 of the guide member 52 faces the base plate 61 having a space therebetween and the rotation holding part 75 is laminated on the end plate 62. The guiding part 74 faces the periphery of one side piece 67 of the holder 51, which is arranged between the end plates 62. The guiding part 74 is arranged at a position nipping the one side piece 67 between the base plate 61 and the guiding part 74.

The guiding part 74 of the guide member 53 faces the base plate 61 having a space therebetween and the rotation holding part 75 is laminated on the end plate 62. The guiding part 74 faces the periphery of another side piece 67 of the holder 51, which is arranged between the end plates 62. The guiding part 74 is arranged at a position nipping the other side piece 67 between the base plate 61 and the guiding part 74.

Each of the guide members 52 and 53 is rotatably held in relation to the end plate 62 around a shaft 78 provided at an end of the rotation holding part 75 away from the guiding part 74. Each of the guide members 52 and 53 is rotatably held around a shaft 78, thereby the guiding parts 74 can approach or leave from each other.

Each of the guide members 52 and 53 has a plurality of guiding hollows 79 on the guiding part 74. The guiding hollow 79 is formed so as to become hollow in the direction, of which the guiding parts 74 are leaving from each other. The guiding hollow 79 is formed along the sidewall 42*b* of the housing 40 mounted in the holder 51.

A plurality of the guiding hollows 79 are arranged at positions for aligning with the inner periphery of the side piece 67 of the holder 51 when the holders 51 leave from each other. Each guiding hollow 79 is arranged along the length direction of the guiding part 74 having a constant interval. When the holders 51 leave from each other and the inner peripheries of the guiding part 74 facing each other has about the same plane as that of the inner periphery of the side piece 67, the guiding hollow 79 aligns with the inner periphery of the side piece 67 of the holder 51.

Since the guiding hollow 79 is formed along the sidewall 42*b* of the housing 40, the guiding hollow 79 guides the housing in such a manner that the projection 70 enters into the hollow groove 48*a* when each housing 40 is mounted in the corresponding holder 51. That is, the housing 40 is moved along the bottom wall 42*a* to be mounted into the holder 51.

A portion of each of the guide members 52 and 53 in the vicinity of the sidewalls 42*b* of the housing 40 mounted in the holder 51 enters into the guiding hollow 79, thereby each of the guide members 52 and 53 positions the housing 40. Each of the guide members 52 and 53 prevents housings 40 from approaching or leaving from each other, that is, prevents the holders 51 from approaching or leaving from each other.

On the other hand, when the guide members 52 and 53 are rotated in the direction, of which the guiding parts 74 leave from each other, by the cam mechanism 54 as described later on, the sidewall 42*b* of the housing 40 mounted in the holder 51 slips off from the guiding hollow 79. Each of the guide members 52 and 53 releases the positioning of the housing 40 so as to allow the housings 40 to approach or leave from each other, that is, to allow the holders 51 to approach or leave from each other.

The cam mechanism 54 rotates the guide members 52 and 53 within a range from a first position to regulate the movement of the housing 40, that is, the movement of the holder 51 to a second position to allow the movement of the housing 40, that is the movement of the holder 51. The cam mechanism 54 positions the guide members 52 and 53 in relation to the frame 50 at both first and second positions.

The cam mechanism 54 has a cam 81 rotatably provided on the end plate 62, an operation lever 82, and a coil spring 83. The cam 81 presses the guide members 52 and 53 so as to rotate them. One end of the operation lever 82 is fixed to the cam 81 and another end of the operation lever 82 is rotated around the one end thereof, thereby rotating the cam 81.

The coil spring 83 is set between the rotation holding parts 75 of the guide members 52 and 53. The coil spring 83 biases the rotation holding parts 75 of the guide members 52 and 53 in the direction approaching each other, thereby positioning the cam 81, that is, positioning the guide members 52 and 53 at both first and second positions.

When the housings 40 are laminated to each other by using the setting jig 1 so as to construct the joint connector 5, first the holders 51 are positioned in a state being apart from each other. Then, the operation lever 82 of the cam mechanism 54 is operated so as to position the guide members 52 and 53 at the first position.

Then, each housing 40 is mounted in the corresponding holder 51. At this time, the guiding hollow 79 guides the insertion direction of the housing 40 to insert the housing 40 along the bottom wall 42*a*. The claw 73 of the lever member 64 engages with the housing 40. Further, a cover housing 49 is mounted on top of the housing 40, which is situated at the top when the joint connector 5 is constructed.

Then, the operation lever 82 of the cam mechanism 54 is operated so as to position the guide members 52 and 53 at the second position. Thereafter, the housings 40 mounted in the holders 51 and the cover housings 49 are pressed in the direction for approaching each other so as to engage each locking claw 44 with the corresponding claw receiver 45, thereby fixing each housing 40 and the corresponding cover housing 49 to each other. Then, each housing 40 and cover housing 49 are removed from the corresponding holder 51, and the joint connector 5 is obtained.

Thereafter, the holder 51 is positioned in a state being apart from each other. The operation lever 82 of the cain mechanism 54 is operated so as to move the guide members 52 and 53 to the first position. Then, the joint connector 5 is assembled as described above.

In this connection, all holders 51 out of the holders 51 described above are not necessarily mounted with the housing 40 and the cover housing 49 to construct the joint connector 5. In such a case, a dummy housing 49*a* as shown in FIG. 11 can be mounted into the holder 51.

Further in such a case, the housing 40 and the cover housing 49 can be in turn mounted into the holder 51 starting from the deepest holder 51 in FIG. 11. That is, the dummy housing 49*a* can be situated at this side in FIG. 11.

Figure 12:
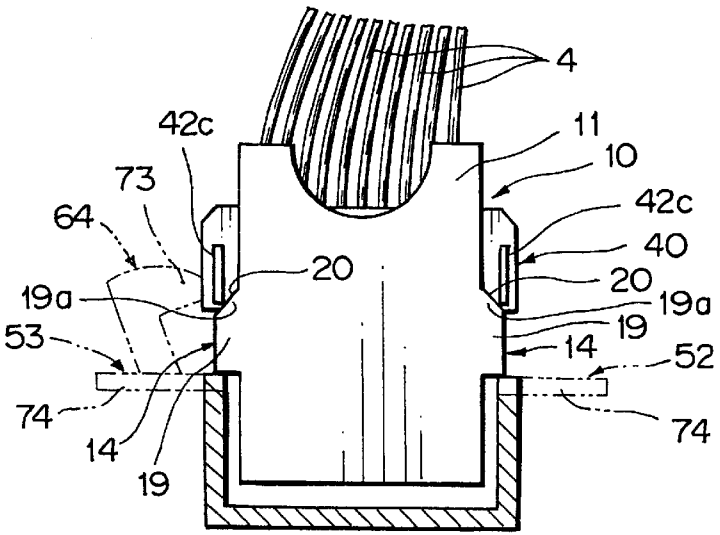
FIG. 12 is a view schematically illustrating a state when a releasing projection of the terminal cover comes into contact with a guide member of the setting jig when the housing having the terminal cover shown in FIG. 8 thereon is mounted in a holder.

The housing 40 is mounted into the holder 51 in a state when the terminal cover 10 is mounted on the housing 40. When the housing 40 on which the terminal cover is mounted is mounted into the holder 51, as shown in FIG. 12, first the projection body 19 of the terminal cover 10 comes into contact with the guiding part 74. Further, when the housing 40 approaches the holding piece 66 of the holder 51, the housing 40 and the terminal cover 10 move relatively to each other in the direction, of which the protecting surface 17 and the tab 37 leave apart from each other.

Figure 13:
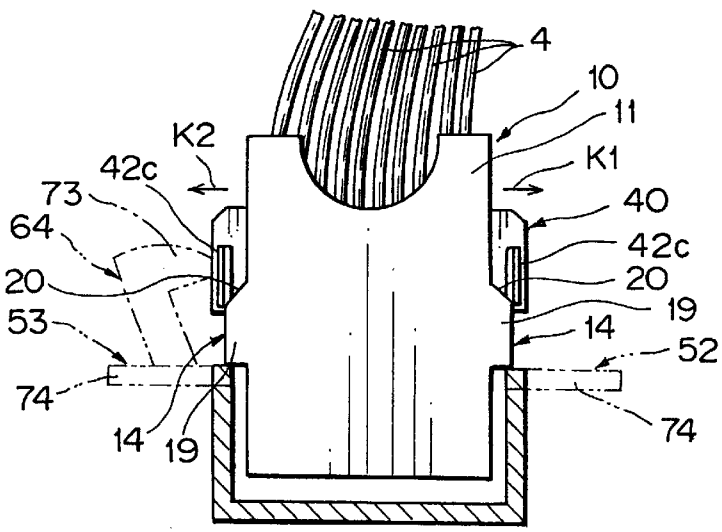
FIG. 13 is a view schematically illustrating a state when a releasing projection of the terminal cover enlarges a space between guide projections of the housing when the housing having the terminal cover shown in FIG. 8 thereon is mounted in a holder.

Then, the inclined surface 20 comes into contact with the guide projection 42*c*. Since the inclined surface 20 gradually inclines toward the inside as facing the guide projection 42*c*, as shown in FIG. 13, the inclined surface 20 elastically deforms the guide projection 42*c* in the direction enlarging the space between a pair of the guide projections 42*c* along arrows K1 and K2. The inclined surafce 20 enlarges the space between a pair of the guide projections 42*c* as the housing 40 is mounted into the holder 51.

Further, when the housing 40 approaches the holding piece 66 of the holder 51, the guiding projection 42*c* climbs over the projection body 19 and the terminal cover 10 is detached from the housing 40. When the housing 40 approaches the holding piece 66 of the holder 51 from a state shown in FIG. 12, the locking projection 13 gradually slips out from the claw receiver 45 of the housing 40.

When the terminal cover 10 according to the preferred embodiment is mounted into the holder 51 in a state when the terminal cover 10 is mounted on the housing 40, the projection body 19 of the releasing projection 14 comes into contact with the guiding part 74. Further, the inclined surface 20 is provided at the end 19*a* of the projection body 19 near to the guide projection 42*c* gradually inclining toward the inside.

Therefore, after coming contact with the guiding part 74, the terminal cover 10 together with the housing 40 is prevented from moving toward the holding piece 66. The inclined surface 20 presses the guide projection 42*c* so as to enlarge the space between a pair of the guide projections 42*c*. Further, after coming contact with the guiding part 74, the inclined surface 20 together with the housing 40 is prevented from moving toward the holding piece 66, therefore the locking projection 13 gradually slips out from the claw receiver 45.

Therefore, when the terminal cover 10 according to the preferred embodiment is mounted into the holder 51 in a state when the terminal cover 10 is mounted on the housing 40, the terminal cover 10 is detached from the housing 10 in response to the movement of being mounted in the holder 51, thereby the time required for assembling the wiring harness can be reduced.

In the preferred embodiment described above, the releasing projection 14 is formed so as to come into contact with the guiding part 74. Instead, the releasing projection 14 may be formed so as not to come into contact with the guiding part 74. In this case, the inclined surface 20 preferably is formed so as to come into contact with the guide projections 42*c*. After the housing 40 on which the terminal cover 10 is mounted is mounted in the holder 51, the terminal cover 10 is pulled out in the direction, of which the protecting surface 17 leaves apart from the tab 37. Then, the inclined surface 20 comes into contact with the guide projections 42*c*, thereby enlarging the space between a pair of the guide projections 42*c*. Then, the terminal cover 10 is removed from the housing 40.

The aforementioned preferred embodiments are described to aid in understanding the present invention and variations may be made by one skilled in the art without departing from the spirit and scope of the present invention.

What is claimed is:

1. A terminal cover to be mounted on an insulator, which arranges and holds a plurality of pressure-welded terminals in parallel therein, a plurality of the insulators being mutually laminated to constitute a joint connector, and when the terminal is being held by the insulator and the insulator is laminated to the other insulator, the terminal has a connecting piece, which extends toward the other terminal mounted in the other insulator and is connectable to the other terminal, and the insulator has a wall for placing the terminal thereon and a pair of guide projections perpendicularly arising from a pair of the peripheries of the wall facing each other, and the terminal cover comprises:

a cover body to be mounted on the insulator being nipped between a pair of the guide projections; and a protecting projection, which protrudes from an end of the cover body toward the outside and situates the connecting piece between the wall and the protecting projection when the cover body is mounted on the insulator.

2. The terminal cover according to claim 1, wherein an end of the cover body is provided with a flat protecting surface along the direction in which the connecting piece extends toward the other terminal, the protecting surface comes into contact with the connecting piece when the cover body is mounted on the insulator, and the protecting projection protrudes from the protecting surface toward the outside.

3. The terminal cover according to claim 1 or 2, wherein the insulator has a claw receiver engaging with a locking claw of the other insulator when the insulators are mutually laminated so as to constitute the joint connector, and the terminal cover has a locking member, which protrudes from the cover body toward the claw receiver and engages with the claw receiver when the cover body is mounted on the insulator.

4. The terminal cover according to claim 3, wherein the insulators are mutually laminated so as to constitute the joint connector by using a setting jig having a plurality of holders, which are capable of holding the insulators and separable from each other, the insulator is mounted in the holder by being moved along the wall, and the terminal cover has a pair of lock releasing members for enlarging a space between a pair of the guide projections as the insulator is mounted in the holder when the terminal cover is mounted on the insulator.

5. The terminal cover according to claim 4, wherein the lock releasing member comprises:

a releasing member body, which protrudes from the periphery of the cover body toward the outside, a pair of the peripheries having a space therebetween along the direction crossing at right angles to the mounting direction of the insulator into the holder, and comes into contact with the setting jig when the insulator is mounted in the holder; and an inclined surface, which is provided at an end of the releasing member body near to the guide projection, capable of coming into contact with the guide projection, and gradually inclined toward the inner direction of the cover body as said inclined surface approaches the guide projection.

6. The terminal cover according to claim 4, wherein the locking member gradually slips out from the claw receiver along the mounting direction of the insulator as the insulator is mounted into the holder.

7. The terminal cover according to claim 5, wherein the locking member gradually slips out from the claw receiver along the mounting direction of the insulator as the insulator is mounted into the holder.

* * * * *